United States Patent [19]

Borstelmann

[11] 4,436,124

[45] Mar. 13, 1984

[54] PROCESS AND APPARATUS FOR BOTTLING OXYGEN-SENSITIVE LIQUIDS

[75] Inventor: Wolfgang Borstelmann, Dortmund, Fed. Rep. of Germany

[73] Assignee: Holstein und Kappert GmbH, Dortmund, Fed. Rep. of Germany

[21] Appl. No.: 339,702

[22] Filed: Jan. 15, 1982

[30] Foreign Application Priority Data

Jan. 28, 1981 [DE] Fed. Rep. of Germany ..... 3102678

[51] Int. Cl.[3] ..... B65B 31/00

[52] U.S. Cl. ..... 141/5; 141/6; 141/7; 141/37

[58] Field of Search ..... 141/4, 5, 6, 7, 9, 37, 141/44, 63, 70, 100, 234, 295, 298, 392, 374

[56] References Cited

U.S. PATENT DOCUMENTS 3,830,265 8/1974 Matejek ..... 141/374 X

*Primary Examiner*—Stephen Marcus
*Assistant Examiner*—Mark Thronson
*Attorney, Agent, or Firm*—Toren, McGeady and Stanger

[57] ABSTRACT

During the process of filling containers with an oxygen-sensitive liquid under pressure, a buffer layer of gas is maintained over the surface of the liquid throughout the filling process in order to maintain the liquid separated from any oxygen which may be present within the container.

7 Claims, 4 Drawing Figures

PROCESS AND APPARATUS FOR BOTTLING OXYGEN-SENSITIVE LIQUIDS

The present invention relates generally to procedures for filling liquids into containers and, more particularly, to a process and apparatus for bottling oxygen-sensitive liquids such as beer or similar beverages. Processes such as that of the present invention are performed under pressure in a process wherein the container, bottle, or can is first placed under a required back pressure and, after equalization of the pressure between the container and the liquid, actual filling of the container is initiated.

It is especially significant in cases where oxygen-sensitive liquids such as beer, mineral water, or the like are to be filled into a container that the portion of air remaining in the container be considered from the point of view of the possibility of causing deleterious effects on the liquids through oxidation.

It has been heretofore endeavored to reduce the air component in the container as much as possible. In the processes for filling containers with liquid, a filling feed pipe is used, with the bottle to be filled being placed beneath the feed pipe. The feed pipe is caused to reach virtually to the base of the container or bottle and the filling action which is undertaken operates by introducing liquid from the bottle or container from the lowermost part thereof and allowing the liquid level to rise upwardly in the container in order to effectuate the filling process.

In processes of this type, the boundary layer on the surface of the liquid experiences a continuing contact with the gas in the space above the liquid due to an inevitable turbulence which develops. This can cause a problem if the container involved has not been evacuated before the filling process and if there has been retained within the container above the liquid a substantial amount of oxygen. If the portion of oxygen retained within the container during the filling process is significant, then the resulting turbulence during the filling process will cause deleterious effects upon the beverage liquid being filled due to contact with the oxygen.

Accordingly, the present invention is directed toward a process and apparatus for enabling the filling of an oxygen-sensitive liquid into a container while providing means for avoiding contact between the liquid and any oxygen which may be retained in the container above the liquid level.

SUMMARY OF THE INVENTION

Briefly, the present invention may be described as a process for filling containers with an oxygen-sensitive liquid under pressure wherein a buffer layer of gas is maintained over the surface of the liquid throughout the filling process in order to maintain the liquid separated from any oxygen which may be present within the container. Thus, the invention operates to create immediately above the surface of the liquid a gas separation layer which maintains the liquid separate from the atmosphere immediately above it in the container.

In a filling process of the type to which the present invention relates, the liquid is essentially poured in from the bottom of the container through a feed pipe which is introduced into the container from the upper opening and which introduces the liquid into the container at the bottom thereof. In the apparatus of the invention, a buffer gas feed pipe is provided arranged generally concentrically with the liquid feed pipe, with the buffer gas feed pipe having nozzles which are maintained during the filling process at a particular location relative to the level of the liquid in order to provide the buffer gas layer throughout the surface of the liquid during the filling process.

It is considered within the scope of the invention to continue the delivery of the buffer gas and to maintain such delivery during the process wherein the pressure on the bottles or containers is released.

With the process and apparatus of the invention, disadvantages which might arise through the prior art are alleviated or eliminated. By means of the buffer gas layer which is constantly maintained on the surface of the liquid, contact between the filling liquid and air or oxygen inside the bottle is precluded.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
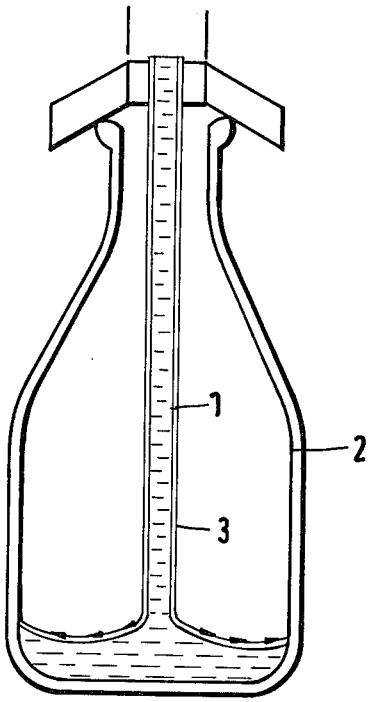
FIG. 1 is a schematic sectional elevation showing a device such as that of the present invention during a filling process.

Referring now to the drawings, there is shown in FIG. 1 apparatus for carrying out the process of the invention wherein a bottle or container 2 is in the process of being filled with an oxygen-sensitive liquid in accordance with the present invention. The apparatus is composed of a liquid feed pipe 1 which, at least at the beginning of the filling process, is arranged to reach virtually to the base or bottom of the container 2.

In addition to the liquid feed pipe 1, there is also provided a buffer gas feed line 3 which terminates at the lower end of the liquid feed pipe 1 and which may be constructed in various ways in accordance with the present invention.

Figure 2:
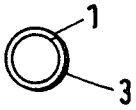
FIGS. 2 and 3 are end views of pipes utilized during the filling process of the invention.

One embodiment of an arrangement or construction for the buffer gas feed line 3 is shown in FIG. 2. In accordance with the embodiment of FIG. 2, the buffer gas feed line 3 is formed as a pipe surrounding the liquid filler pipe 1. During the filling process, by means of control devices (not shown) the buffer gas feed pipe 3 is moved in order to be maintained a specific distance above the liquid level so that the buffer gas layer may be emitted at the level of the liquid, as indicated by the arrows in FIG. 1. The position of the buffer gas feed pipe 3 is selected so that complete protection of the upper surface of the liquid by the buffer gas layer will be ensured.

Figure 4:
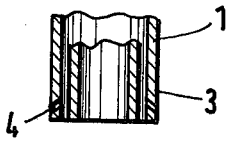
FIG. 4 is a longitudinal sectional view showing the liquid feed pipe and buffer gas feed line of the invention.

As indicated in FIG. 4, the buffer gas feed pipe 3 may be formed with nozzles 4 or other similar corresponding directional guide means for causing the buffer gas layer to be emitted in the proper manner.

Figure 3:
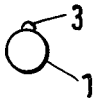

Insofar as the liquid feed pipe 1 is concerned, the pipe 1 may be likewise constructed to be vertically movable and the buffer gas feed line 3 may be composed of a pipe, as shown in FIG. 3, arranged on the outer circumference of the liquid pipe line 1, said pipe being connected with a nozzle mouthpiece in the region of the liquid outlet.

A practical arrangement of a device for performing the process of the present invention involves connection of the buffer gas feed line 3 with an adjustment device which receives its adjusting impulses by means of electronic and/or photoelectronic liquid level sensors. It is, however, also within the context of the invention to equip the lower part of the buffer gas feed line, and in the case where the liquid feed pipe is moved along therewith also the mouthpiece of the feed pipe, with corresponding sensor which will ensure that there will be provided an adequate distance of the buffer gas emission nozzles 4 relative to the actual level of the liquid so that the nozzles 4 may issue the buffer gas layer at the appropriate location.

The bottle 2 is brought under an appropriate filling element, not shown in the drawings, and is first placed under an initial pressure for the purpose of pressure equalization so that a constant or balanced pressure will prevail in the bottle and in the assigned liquid container. Thereupon, immediately an accordingly designed liquid valve means will open so that the liquid, as seen in FIG. 1, may be filled into the container 2 from the bottom upwardly. With the opening of the valve for introducing liquid into the container, or immediately prior thereto, the buffer gas valve is opened thereby permitting commencement of flow of the buffer gas into the buffer gas feed line 3. Thus, there will be emitted from the nozzles a buffer gas layer directly above the liquid level as the liquid level commences to rise within the container 2.

The delivery of the buffer gas may be terminated at the end of the filling process. However, it may also be permitted to continue in order to maintain delivery of the buffer gas until the bottle is released from the pressure or until the interior pressure of the bottle has been brought to atmospheric level so that any influence of surrounding air on the bottle liquid will be precluded.

While specific embodiments of the invention have been shown and described in detail to illustrate the application of the inventive principles, it will be understood that the invention may be embodied otherwise without departing from such principles.

What is claimed is:

1. A process for filling a container having a top and a bottom with an oxygen-sensitive liquid under pressure comprising the steps of inserting a liquid feed pipe into said container from said top of said container and dispensing into said container at said bottom thereof a liquid to be filled into said container, said liquid defining a rising level of liquid during said filling process, introducing into said container through a buffer gas feed line a buffer gas for maintaining a buffer layer of said gas above said rising level of said filling liquid, moving said buffer gas feed line in accordance with said rising level of liquid within said container in order to continuously maintain said buffer gas layer over said liquid throughout the filling process.

2. Apparatus for filling a container having a bottom with an oxygen-sensitive liquid under pressure comprising liquid feed means adapted to be inserted into said container for feeding liquid into said container from said bottom thereof, said liquid defining a rising liquid level during feeding thereof through said liquid feed means, buffer gas feed means adapted to feed into said container a buffer gas layer over said rising liquid level during feeding of said liquid by said liquid feed means, said buffer gas feed means being movable together with said rising liquid level within said container during feeding of said liquid.

3. In a process for filling containers with an oxygen-sensitive liquid under pressure, said liquid defining a surface of said liquid during said filling process, the improvement which comprises that a buffer layer of gas is maintained over said surface of said liquid throughout said filling process to maintain said liquid separated from any oxygen which may be present within the container, said buffer gas being continuously delivered to said container during the filling process, and that said container is depressurized with said delivery being maintained during said depressurizing of said container.

4. Apparatus according to claim 2 wherein said buffer gas feed means comprises a buffer gas feed line including nozzles arranged in said buffer gas feed line to issue therefrom a buffer layer of gas to entirely cover said rising liquid level.

5. Apparatus according to claim 2 wherein said liquid feed means remain stationary during the filling process and wherein said buffer gas feed means are arranged to adapt their position at a particular distance relative to said rising liquid level.

6. Apparatus according to claim 2 wherein said buffer gas feed means are adapted to have the position thereof adjusted to be maintained at a specified distance relative to said rising liquid level.

7. Apparatus according to claim 2 wherein said liquid feed means and said buffer gas feed means are constructed to be vertically movable in common.

* * * * *